US011678702B2

(12) United States Patent
Kim et al.

(10) Patent No.: US 11,678,702 B2
(45) Date of Patent: Jun. 20, 2023

(54) FACE MASK

(71) Applicant: Kimberly-Clark Worldwide, Inc., Neenah, WI (US)

(72) Inventors: KyoungRock Kim, Seongnam-si (KR); Dami Han, Yongin-si (KR); JeongSook Kim, Seongnam-si (KR); HoMyung Yang, Seongnam-si (KR)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/625,335

(22) PCT Filed: Aug. 3, 2021

(86) PCT No.: PCT/US2021/044277
§ 371 (c)(1),
(2) Date: Jan. 6, 2022

(65) Prior Publication Data

US 2023/0040090 A1 Feb. 9, 2023

(51) Int. Cl.
*A41D 13/11* (2006.01)

(52) U.S. Cl.
CPC ..... *A41D 13/11* (2013.01)

(58) Field of Classification Search
CPC ..... A62B 18/00; A62B 18/02–025; A62B 18/088; A62B 23/00–025; A62B 7/10
See application file for complete search history.

(56) References Cited

U.S. PATENT DOCUMENTS

| | | | | |
|---|---|---|---|---|
| 4,384,577 | A | 5/1983 | Huber et al. | |
| 2008/0271737 | A1* | 11/2008 | Facer | A41D 13/11 128/205.25 |
| 2012/0125344 | A1 | 5/2012 | Steindorf et al. | |
| 2021/0361986 | A1* | 11/2021 | Yoshioka | A41D 13/113 |

FOREIGN PATENT DOCUMENTS

| | | | |
|---|---|---|---|
| CN | 1757341 | A | 4/2006 |
| JP | 3159977 | U | 6/2010 |
| KR | 101789107 | B1 | 10/2017 |

* cited by examiner

*Primary Examiner* — Rachel T Sippel

(57) ABSTRACT

An off-the-face mask including a mask body comprising one or more layers and having a surface area defined by a plurality of zones, wherein at least two of the plurality of zones have different stiffness levels; and one or more straps coupled to the mask body and configured to hold the mask on a wearer of the mask.

5 Claims, 8 Drawing Sheets

FACE MASK

TECHNICAL FIELD

This disclosure generally relates to off-the-face masks and respirators.

BACKGROUND OF THE DISCLOSURE

Disposable masks and respirators find utility in a variety of, for example, manufacturing, laboratory, custodial, healthcare and household applications. In these types of applications, masks and respirators filter out dust and other particulate aerosols to protect the respiratory system of the wearer from harmful or irritating contaminates and, in some environments, prevent the wearer from contaminating a delicate or sensitive process, e.g., pharmaceutical or semi-conductor manufacturing lines.

To accomplish these goals it is often desirable to ensure the mask or respirator fits snuggly against and intimately contacts the wearer's face to prevent contaminates from escaping or entering around the periphery of the mask or respirator. But, in doing so, the pressure (e.g., from the mask head straps or ear loops) applied to the mask to cause the mask to "seal" around the wearer's nose and mouth (or more generally, face) can be uncomfortable or cause irritation to the wearer. Thus there is a challenge to provide a good seal around the wearer's face to promote good protection without applying undue pressure making the mask or respirator uncomfortable to wear. This is even more of a challenge with off-the-face masks as these types of masks and respirators must be stiff enough to maintain their form without collapsing—such stiffness often adversely impacts the wearer's comfort.

SUMMARY OF THE DISCLOSURE

In general, the subject matter of this specification relates to a mask or respirator. One aspect of the subject matter described in this specification can be implemented in an apparatus that includes an off-the-face mask comprising a mask body comprising one or more layers and having a surface area defined by a plurality of zones, wherein at least two of the plurality of zones have different stiffness levels; and one or more straps coupled to the mask body and configured to hold the mask on a wearer of the mask. Other embodiments of this aspect include corresponding methods and systems.

Another aspect of the subject matter described in this specification can be implemented in methods that include forming a mask body comprising one or more layers, wherein the mask body has a surface area defined by a plurality of zones and at least two of the plurality of zones have different stiffness levels; and attaching one or more straps to the mask body to hold the mask on a wearer of the mask. Other embodiments of this aspect include corresponding systems and apparatus.

Particular embodiments of the subject matter described in this specification can be implemented so as to realize one or more of the following advantages. For example, the mask or respirator has zones of different stiffness to provide a strong, collapse resistant mask while providing enough material compliance in specific zones to allow the mask to closely follow and engage the contours of the wearer's face (e.g., to seal the mask to the wearer's face and get a good fit) without applying excessive force to or causing skin irritability in those areas of the mask that touch the wearer's face, which can make the mask uncomfortable to wear.

The masks can optionally have a nose flap that easily conforms to and follows the contours of the wearer's nose and cheeks to provide a good fit, comfort and seal to the wearer's face without the use of or need for a nose clip or metallic or rigid or semi-rigid nose piece conventionally used to bend to shape and conform the mask to the wearer's face.

The details of one or more implementations of the subject matter described in this specification are set forth in the accompanying drawings and the description below. Other features, aspects, and advantages of the subject matter will become apparent from the description, the drawings, and the claims.

Figure 1A:
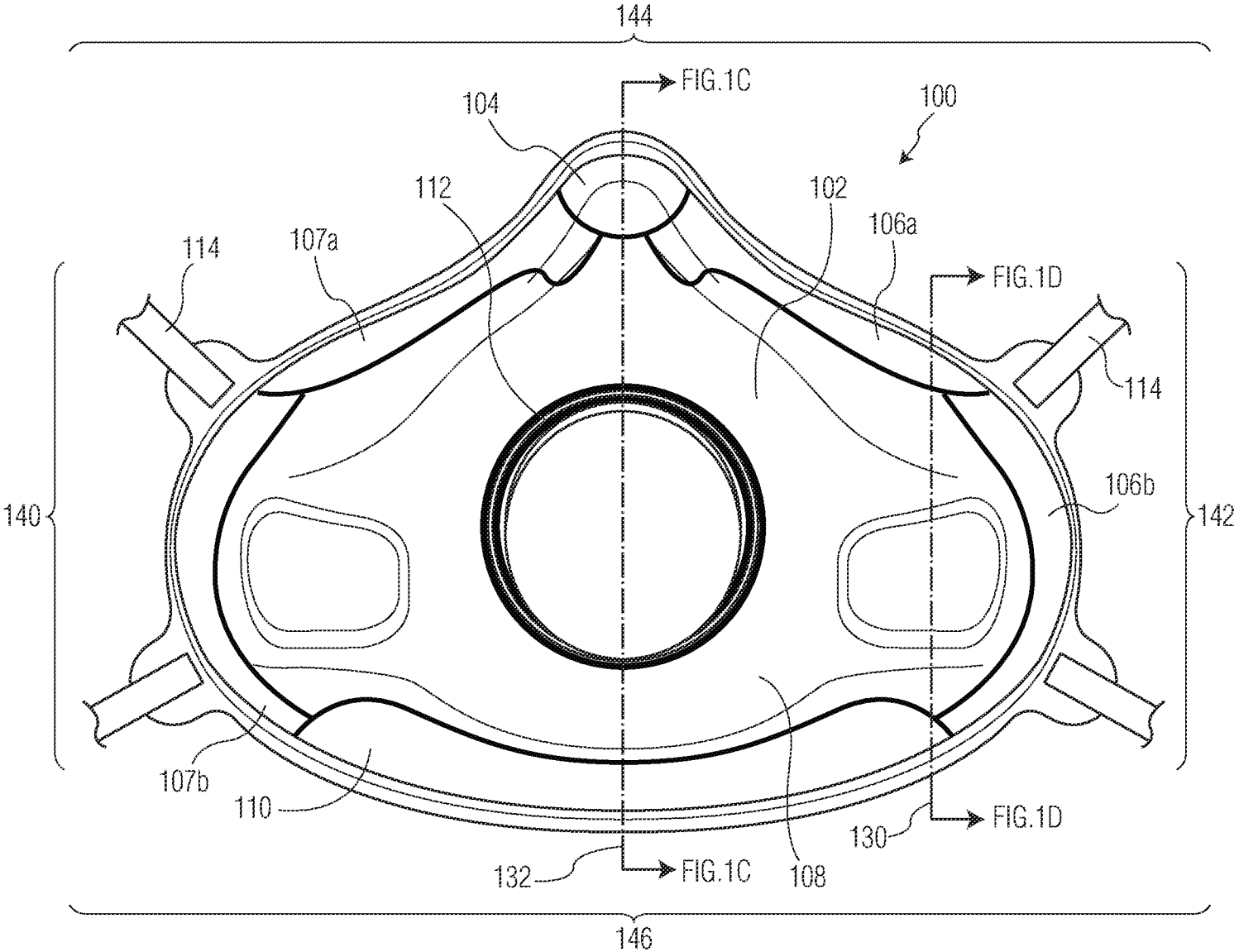
FIG. 1A is a representation of an example face mask.

Repeat use of reference characters in the present specification and drawings is intended to represent the same or analogous features or elements of the disclosure.

DETAILED DESCRIPTION OF THE DISCLOSURE

The present disclosure generally relates to an off-the-face mask or respirator, for example, a disposable mask, that includes different zones of rigidity across the extent of the mask body, for example, from side-to-side (e.g., the side proximate the left ear to the side proximate the right ear) and/or top-to-bottom (e.g., the top side proximate the nose to the bottom side proximate the chin). The mask has zones of high rigidity, for example, where its needed to give the mask strength and zones of low rigidity, for example, where the mask needs to be flexible for comfort and/or fit. For example, the mask can have a low rigidity zone around the nose section to allow the mask to easily conform to the shape of the wearer's nose and a high rigidity zone at the apex of the mask (e.g., the center part of the mask furthest away from the wearer's face) as that zone needs to resist collapsing into contact with the wearer's face. In this way, using different rigidity (or stiffness) zones across the mask, a comfortable and robust mask can be designed. For convenience mask and respirator will be used interchangeably herein.

As used herein, the term "disposable" includes single use articles and articles that are so relatively inexpensive to the consumer that they can be discarded if they become soiled or otherwise unusable after only one or a few uses. Such "disposable" articles are designed to be discarded after a limited use rather than being restored for reuse.

As used herein, the term "off-the-face" describes a mask that holds it shape, e.g., resists changing it's shape, is packaged and shipped in a configuration similar to the configuration in which it is worn, and, except for the perimeter portions of the mask, is not in intimate contact (e.g., touching) with the face of the wearer, or some combination thereof. Such an off-the-face mask is in contrast to, for example, a pleated-type mask (e.g., as generally shown in FIGS. 1-3 of European Patent No. EP0695774 entitled "Face mask with enhanced seal and method of manufacturing of such a mask.").

The mask is described in greater detail below with respect to FIG. 1A, which is a representation of an example face mask 100; FIG. 1B, which is a perspective representation of the face mask of FIG. 1A; FIG. 1C, which is an exaggerated representation of a cross section of the face mask of FIG. 1A; and FIG. 1D, which is an exaggerated representation of a second cross section of the face mask of FIG. 1A.

The mask 100 includes a mask body 102. The mask body 102 is the portion of the mask 100 adapted to filter, screen, or otherwise affect at least a portion of one or more constituents in air or gas being inhaled or exhaled through the mask 100. The mask body 102 can be in a variety of shapes and sizes, depending upon the desired end use of the mask 100. The mask body 102, for example, has a pre-formed or pre-molded cupped configuration and is immediately ready for use, e.g., no alteration, for example, unfolding or opening from a storage configuration of the mask 100 is needed to fit over some portion of the face of a user.

Figure 4:
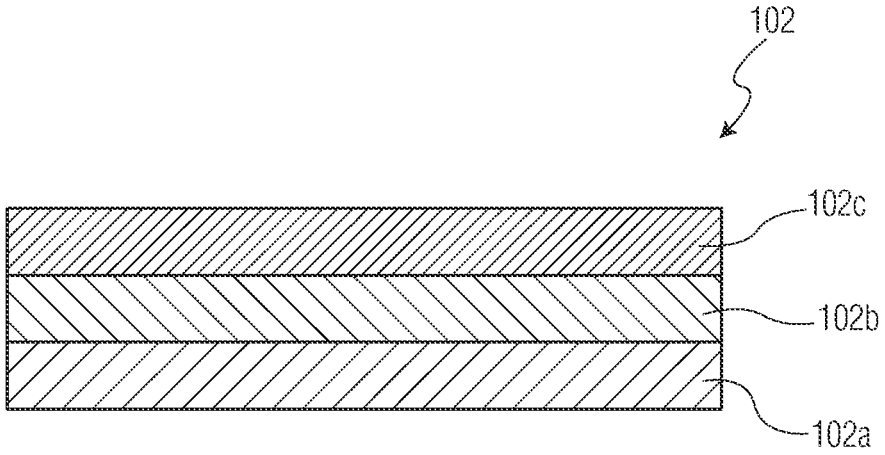
FIG. 4 is a representation of a cross section of an example mask.

The mask body 102 is made of one or more layers, e.g., stacked or assembled together. Each of these layers can be made from a nonwoven web material, woven materials, knit materials, films, or combinations thereof. In some implementations the layer(s) of the mask body 102 are made from a nonwoven web material, for example, needle punched webs, meltblown webs, spunbonded webs, bonded carded webs, wet-laid webs, airlaid webs, coform webs, hydraulically entangled webs, and combinations thereof. Such nonwoven webs may contain synthetic fibers (e.g., polyethylenes, polypropylenes, polyvinyl chlorides, polyvinylidene chlorides, polystyrenes, polyesters, polyamides, polyimides, polyhydroxyalkanoates, polylactic acids, lyocell, etc.), natural fibers (e.g., cotton) or some combination thereof. In some implementations, the mask body 102 has three layers: a first layer (102*a* from FIG. 4) formed from a needle punched web, a second (middle) layer (102*b* from FIG. 4) formed from a meltblown web and a third layer (102*c* from FIG. 4) formed from a spunbond web. In some implementations, the fibers of one or more of the layers of the mask body 102 (e.g., meltblown nonwoven web layer) are electrostatically charged to, for example, attract and trap particles that try to penetrate the mask body 102.

In some implementations, the mask body 102 can be formed, for example, by placing a first layer (e.g., inner layer nearest the wearer's face when worn) into a (metal or plastic) mold having the desired shape and contours for the mask 100 and, by applying pressure and/or heat to the first layer while in the mold, molding the first layer to create a self-supporting layer having the shape and contours of the mold. Subsequent layers, if any, can be attached to the first layer through bonding or the like, e.g., ultrasonic welding, thermal point bonding, adhesive bonding, etc. Such subsequent layers can bonded to the first or other layers with or without first being separately molded in the mold. For example, in some implementations, all layers are placed in the mold and molded together through pressure and/or heat. In the case of not being separately molded such subsequent layers hold their form based on their direct or indirect (e.g., through intervening layers) bonding to the self-supporting first layer.

As described above, the mask body 102 has a surface area defined by a plurality of zones (e.g., 104, 106*a,b*, 107*a,b*, 108, 110). The surface area of the mask body 102 describes the expanse (e.g., including through the thickness of the mask body 102) of the mask 100 extending from one side portion 140 to the other side portion 142 and from the top portion 144 to the bottom portion 146. In some implementations, at least two of the plurality of zones have different stiffness levels. A stiffness level describes the resistance of the corresponding portion of the mask body 102 to bending or changing its shape. A high stiffness level means the corresponding portion of the mask body 102 is highly resistant to bending or changing its shape under an applied load and a low stiffness level, compared to the high stiffness level, means the corresponding portion of the mask body 102 more easily or readily bends or changes its shape under a (same) applied load. Stiffness levels of sample pieces of material (e.g., 10 cm×10 cm square samples) can be measured, for example, according to, ASTM D1388 or ISO9073-7 test protocols. The applied load can be, for example, the load applied to the mask body 102 by a wearer stretching or tensioning the head straps 114 or ear loops of the mask 100 to secure the mask 100 to the wearer. In some implementations, whether a high or low stiffness level, the various portions of the mask body 102 are resilient such that once the applied load is removed the portions/zones of the mask body 102 tend to at least partially recover to their original shape.

In some implementations, the different level of stiffnesses can be imparted by varying the thickness of the mask body 102 across the different zones. For example, to increase the stiffness level of a zone one or more of the layers (e.g., the inner layer) in that zone can be subjected to additional heat and/or pressure in the molding process to cause the synthetic fibers in that layer (e.g., polyester or co-polyester) to further compact and/or more highly crystallize making that portion of the layer thinner and stiffer. To decrease the stiffness level of a zone one or more of the layers (e.g., the inner layer) in that zone can be subjected to less heat and/or less pressure in the molding process to prevent the synthetic fibers in that layer from being overly compacted and hardened (e.g., less highly crystallized) making that portion of the layer thicker and less stiff. In this way, e.g., assuming all other layers are constant across zones, the overall stiffness of a zone can be controlled by the application of heat and/or pressure during the molding process. This is referred to as Molding Process 1. For example, the mask body 102 can have three layers: a first (inner) layer (102*a* from FIG. 4, the layer closest to the wearer's face) formed from a needle-punched polyester web, a second (middle) layer (102*b* from FIG. 4) formed from a meltblown web and a third (outer) layer (102*c* from FIG. 4) formed from a spunbond web, and each of these webs can be uniform pre-moldiing, with the stiffness variation across zones coming from the molding process, as described above.

In some implementations, the stiffness changes generated by the molding process are attributed to the designed gap between upper mold and lower mold (into which one or more of the layers are formed). For example, to make a zone stiffer, this gap can be very small and to make a zone less stiff this gap can be larger such that more heat and/or pressure are applied where the mold gap is less/smaller.

In an alternative implementation, for example, to increase the stiffness level of a zone the overall thickness of one or more of the layers in that zone can be increased and to decrease the stiffness level of a zone the overall thickness of one or more of the layers in that zone can be decreased. In other implementations, the stiffness levels can be adjusted (additionally or alternatively to adjusting thickness) by changing the layer composition, for example by using layers with denser fiber constructs, thicker fibers, less malleable fibers/different types of fibers, different types of fiber web forming processes, different additives or coatings to the webs/layers, adding additional layers in the zone of interest, adding strengthening features like ribs, or the like.

In some implementations, the zones include a nose contacting portion 104 proximate a nose of a wearer when the mask 100 is worn; a chin contacting portion 110, opposite the nose contacting portion 104, proximate a chin of the wearer when the mask 100 is worn; upper and lower left side portions 106*a,b* collectively extending proximate at least a portion of the periphery of the mask body 102 between the chin and nose contacting portions 104, 110 on one side 142 of the mask body 102; upper and lower right side portions 107*a,b*, opposite the left side portion 106, collectively extending proximate at least a portion of the periphery of the mask body 102 between the chin and nose contacting portions 104, 110 on another side 140 of the mask body 102; a first central portion 112 in a middle of the mask body 102 surrounding an apex portion 113 (e.g., over which a vent 309 can be placed); and a second central portion 108 surrounding the first central portion 112 and between the chin contacting 110, nose contacting 104, left side 106*a,b* and right side 107*a,b* portions. In some implementations, fewer, additional and/or different zones are contemplated.

In some implementations, the zone having the highest stiffness level (e.g., chin contacting portion 110) has a thickness of between 0.2 and 4 mm, between 0.3 and 3 mm or 0.3 to 2 mm. Likewise, in some implementations, the zone having the lowest stiffness level (e.g., nose contacting portion 104) has a thickness of between 1.0 to 4 mm, 1.5 to 4 mm, or 2 to 5 mm.

Figure 1B:
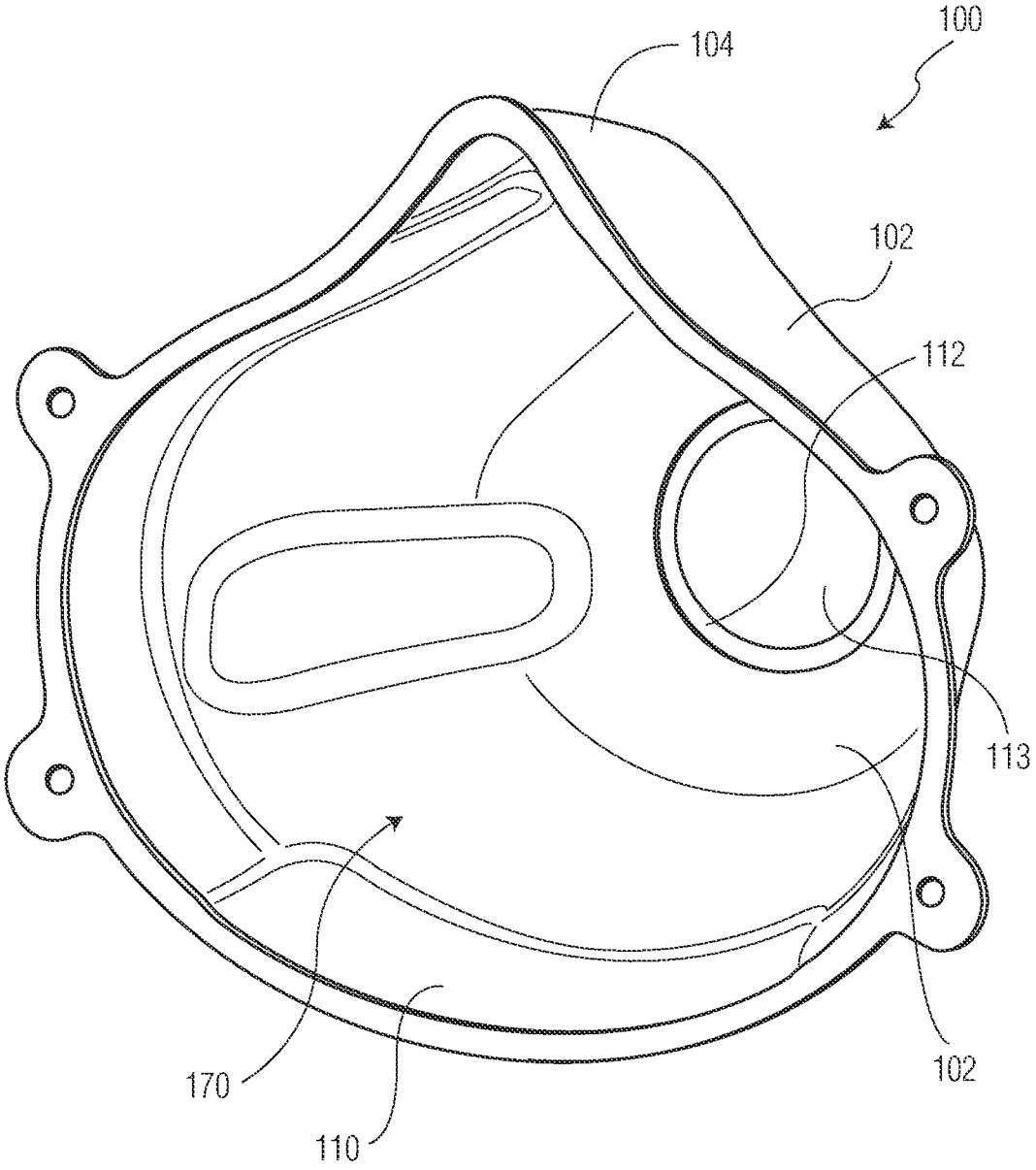
FIG. 1B is a perspective representation of the face mask of FIG. 1A.
Figure 1C:
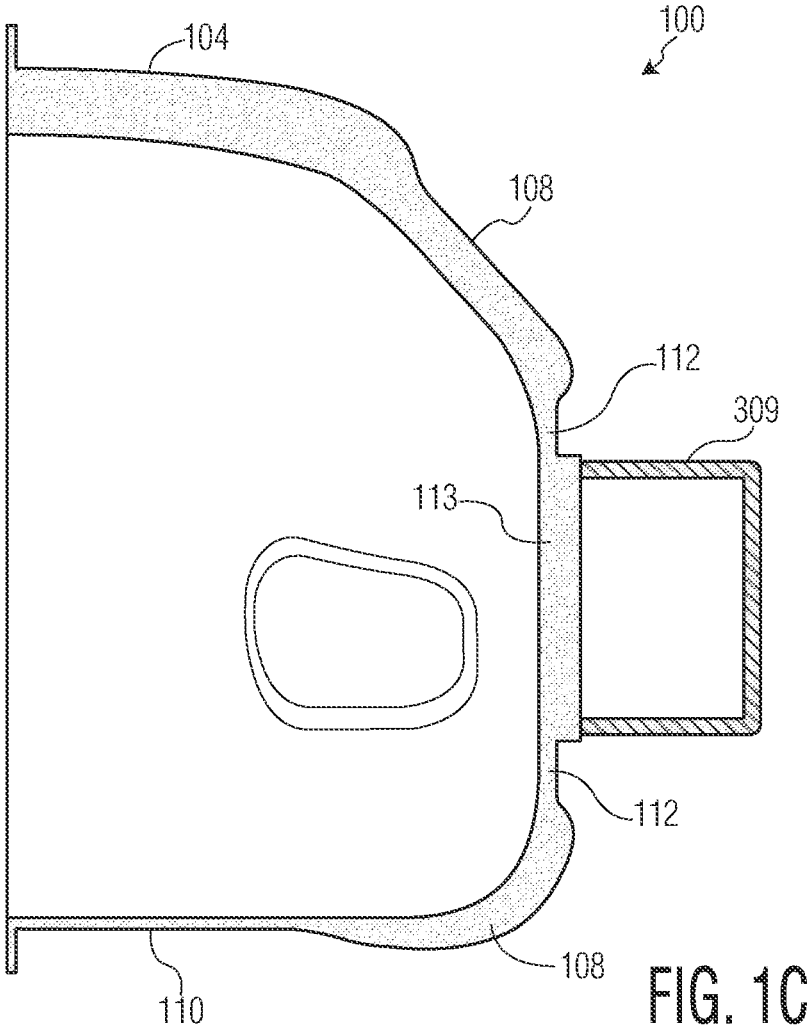
FIG. 1C is a representation of a cross section of the face mask of FIG. 1A.
Figure 1D:
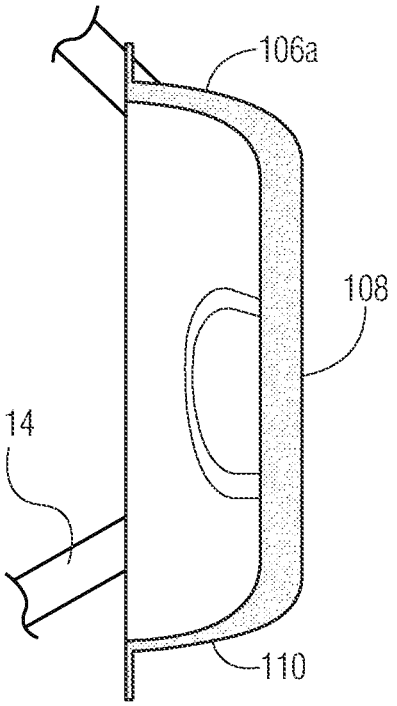
FIG. 1D is a representation of a second cross section of the face mask of FIG. 1A.
Figure 1E:
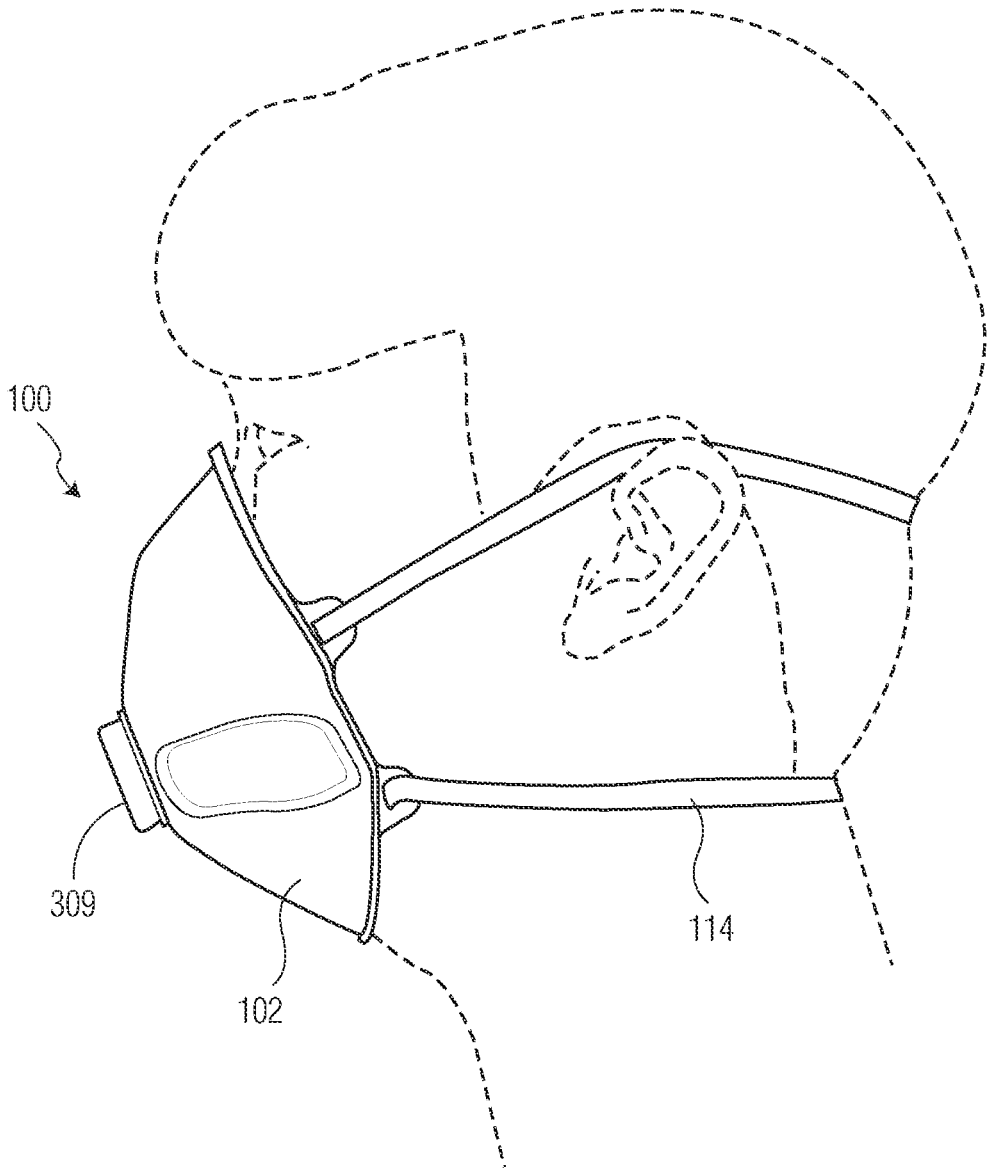
FIG. 1E is a representation of a user wearing the face mask of FIG. 1A.
Figure 2:
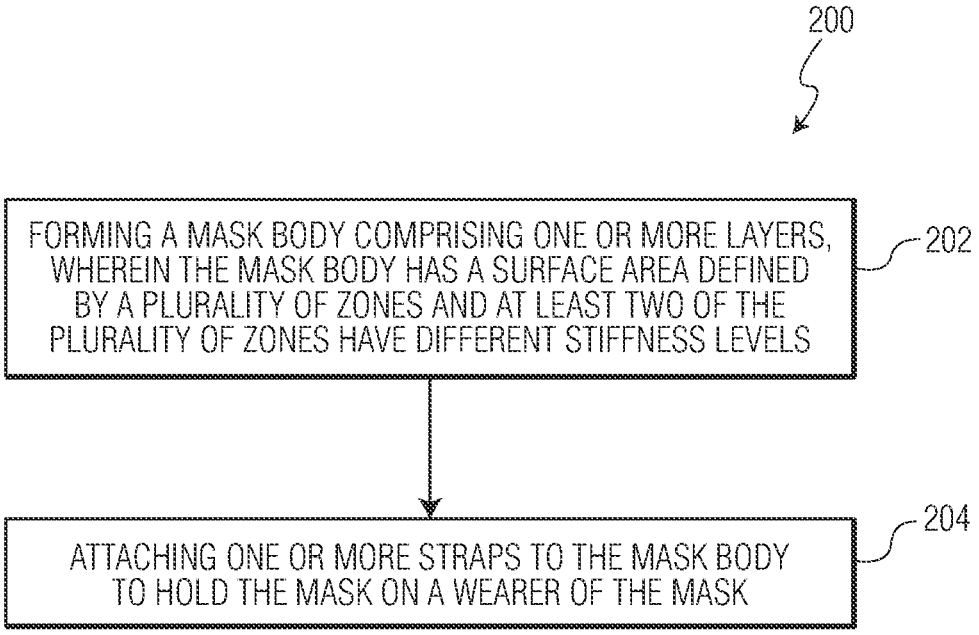
FIG. 2 is a flow chart of an example process for making a face mask.

FIG. 1C shows a cross section of the mask 100 along line 132 of FIG. 1A. As shown in FIG. 1C, the stiffness of the various zones can be different. For example, based on Molding Process 1, the nose contacting portion 104 is less stiff/softer (because it is thicker) than the second central portion 108, which is less stiff/softer than the first central portion 112. Likewise, FIG. 1D is a cross section of the mask 100 along line 130 from FIG. 1A. As shown in FIG. 1D, the upper left side and upper right side portions 106*a*, 107*a* are stiffer (because they are thinner) than the second central portion 108.

Figure 3A:
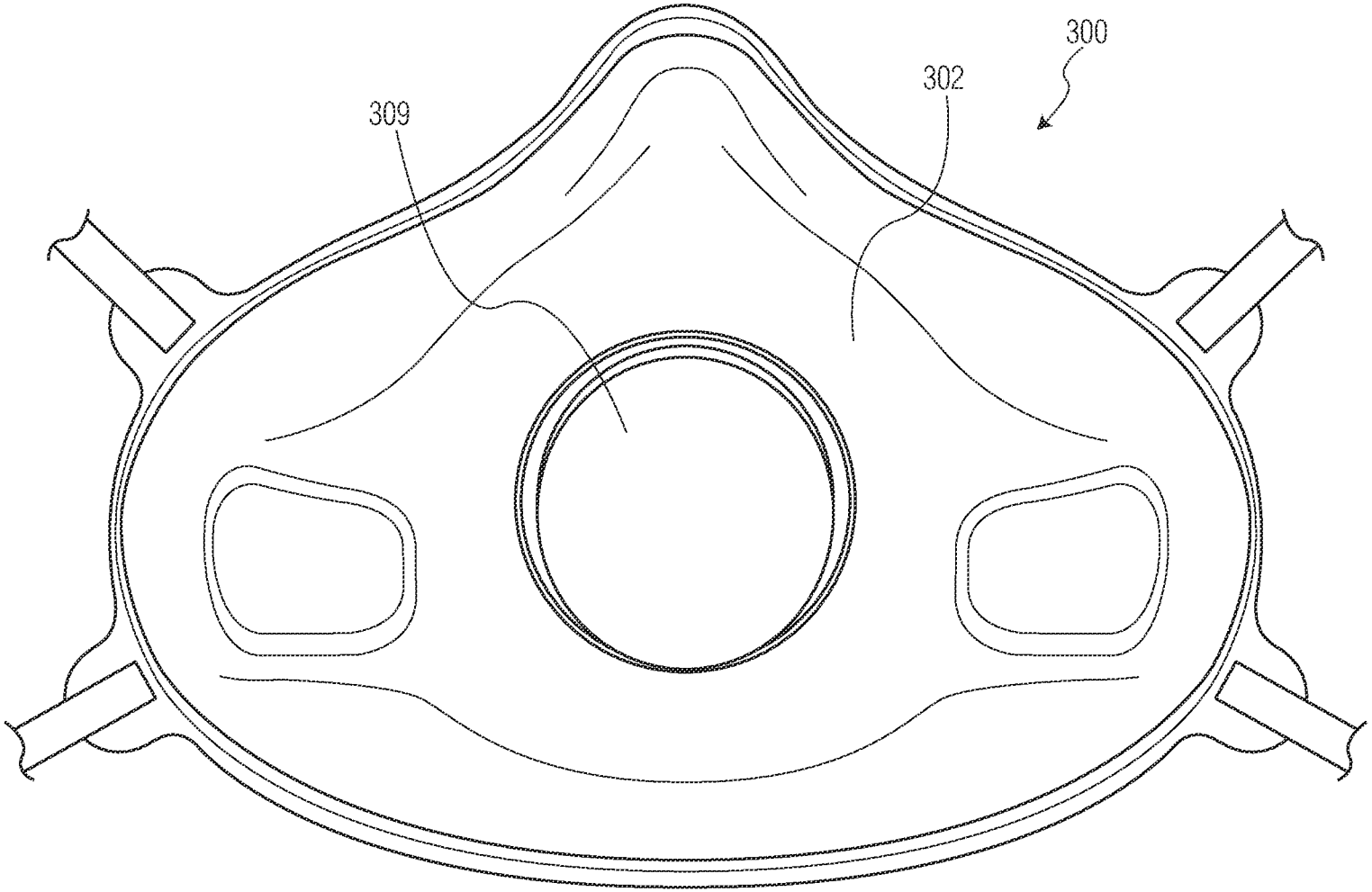
FIG. 3A is a representation of another example face mask.

In some implementations, the first central portion 112 surrounds an exhalation vent (e.g., numeral 309 in FIG. 3A). An exhalation vent is a channel or device that facilitates movement of exhaled air from the wearer out of the mask 100. Furthermore, such a vent can provide for a greater volumetric flow rate of exhaled air to be conducted through the vent, rather than outward through the mask body 102.

The mask 100 also includes one or more straps 114 coupled to the mask body 102 to hold the mask 100 on a wearer. The straps 114 can be coupled to the mask body 102, for example, through bonding including ultrasonic bonding, thermal point bonding, adhesives, stapling and the like. The straps 114 operate as a support system to hold the mask 100 on the face of the wearer. In some implementations, the straps 114 are headbands, ear loops or tie straps. The straps 114 can be, for example, two thin elastic bands integrally attached to the mask body 102. In these types of implementations, the two straps 114 are intended to encircle the back and top of a wearer's head to help facilitate a close, tight fit. The straps (or strap in the case where only one strap is used) 114 may be made of woven, nonwoven, rubber, plastic, elastics (e.g., synthetic elastics) other materials, or combinations thereof.

In some implementations, the nose contacting portion 104 has a lowest stiffness level, for example, to encourage that zone of the mask 100 to readily conform to the contours of the wearer's nose to ensure a good seal in this zone and prevent contaminates leaking in or out of the mask 100 in this area if there was poor seal to the wearer's face.

In some implementations, at least one or both of the chin contacting portion 110 and first central portion 112 have a highest stiffness level, and the apex 113 portion has a less stiff level than the first central portion 112. The first central portion 112 generally forms (at least partially with the second central portion 108 and/or the apex 113 portion) the breathing chamber 170 of the mask 100 (e.g., the part of the mask 100 holding air to be inhaled by the wearer as shown inn FIG. 1B) and thus includes the portion of the mask 100 most prone to collapse from the wearer's respiration during use (e.g., the suction during an inhale), from the force applied to that first central portion 112 from the tension of the straps 114 around the wearer, and/or form the stress of wearers grabbing the mask 100 while donning/doffing the mask 100, as wearers often grab the mask body 102 (e.g., at second central portion 108) which can cause the mask 100 to collapse or deform but the stiff central portion 112 (e.g., in a ring shape) helps to, prevent collapsing and maintain mask body shape. Thus, in some implementations, it can be beneficial to have the first central portion 112 have a high stiffness level. In some implementations, it can be beneficial to have the chin contacting portion 110 have a high stiffness level to minimize linting as less stiff material can lint more frequently than stiffer materials. Such linting can cause discomfort to the wearer.

In some implementations, the upper and lower left side portions 106*a,b* and upper and lower right side portions 107*a,b* have stiffness levels greater than the nose contacting portion 104 and/or less than the chin contacting portion 110. Given this zone often covers the wearer's cheeks, which have less topography than, for example, the nose in the nose contacting portion 104, these the upper and lower left side portions 106*a,b* and upper and lower right side portions 107*a,b* can have higher stiffness levels than the nose contacting portion 104 to resist collapse, as these sections often receive direct tension from the straps 114 when the mask 100 is worn.

In some implementations, the first central portion 112 has a stiffness level greater than the second central portion 108. For example, as the second central portion 108 can comprise a majority of the center portion of the mask body 102 and to accommodate for the different sizes and shapes of various wearers' faces this zone can have a lower stiffness level than the first central portion 112 and/or a higher stiffness level than the nose contacting portion 104 as the nose contacting portion 104 often sees the greater topology differences and needs to conform to such differences through lower stiffness levels.

A Leakage Test according to OSHA 29 CFR 1910.134 was conducted on a mask having three layers, with the first layer being a 160 GSM needle punched polyester layer, the second layer being a 35 GSM meltblown polypropylene, and the third layer being a 40 GSM spunbond polypropylene, with layers being cornered through Molding Process 1 (New Sample), and having the following relevant stiffness levels from 1 to 4 with 4 being the most stiff and 1 being the least stiff:

| Zone | Stiffness Level | Thickness (millimeters) |
|---|---|---|
| Nose contacting portion 104 | 1 | 2.0 mm |
| Chin contacting portion 110 | 4 | 0.75 mm |
| Upper left side portion 106a | 3 | 1.0 mm |
| Upper right side portion 107a | 3 | 1.0 mm |
| Lower left side portion 106b | 2 | 1.5 mm |
| Lower right side portion 107b | 2 | 1.5 mm |
| First central portion 112 | 4 | 0.75 mm |
| Second central portion 108 | 2 | 1.5 mm |
| Apex portion 113 | 2 | 1.5 mm |

The Comparative mask example is the same construction as the New Sample (and formed with Molding Process 1) but with only a single rigidity level across the entire mask body corresponding to stiffness level of 2.5. The results of the Leakage Test over a group of six adult participants showed the New Sample had an average leakage rate of 1.9 percent and the Comparative mask example had an average leakage rate of 3.6 percent. For a group of twelve participants, twenty-five percent responded that the Comparative mask example caused pain or skin redness while none of the participants reported any such pain or skin redness wearing the New Sample, and half of these participants reported an itchy feeling while wearing the Comparative mask example with no participants reporting such a feeling while wearing the New Sample.

For a group of twelve participants, twenty-five percent reported that the mask body of the Comparative mask example had some crushing damage after wearing with no participants reporting crushing damage for the New Sample.

FIG. 2 is a flow chart of an example process 200 for making a face mask 100.

Forming a mask body comprising one or more layers, wherein the mask body has a surface area defined by a plurality of zones and at least two of the plurality of zones have different stiffness levels. (202). For example, forming a mask body 102 where the mask body has multiple zones with at least two different stiffness levels among those zones, for example, a nose contacting portion 104, a chin contacting portion 110, upper and lower left side portions 106*a,b*, upper and lower right side portions 107*a,b*, a first central portion 112 surrounding an apex portion 113, and a second central portion 108.

Attaching one or more straps to the mask body to hold the mask on a wearer of the mask (204). For example, attaching straps 114 to the mask body 102.

Figure 3B:
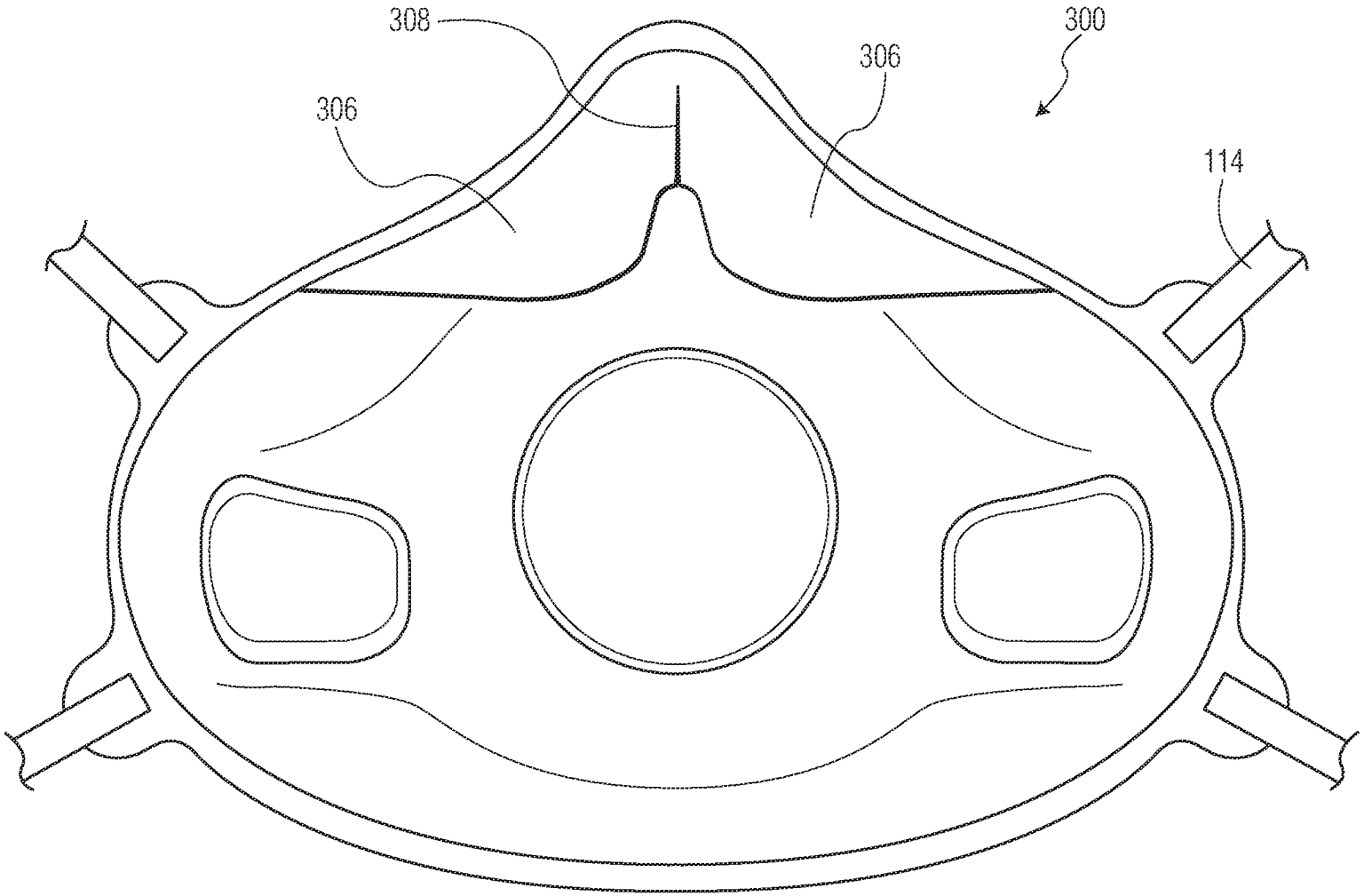
FIG. 3B is a representation of a second view of the example face mask of FIG. 3A.

In some implementations, the mask 300, includes a nose flap 306, a nose slit 308 or both, as shown in FIG. 3A, which is a representation of another example face mask 300, and FIG. 3B, which is a representation of a second view of the example face mask 300. The nose flap 306 is a portion of the mask body 102 extending down towards the breathing chamber 170 to lay down over or on the nose of the wearer when the mask 300 is worn. The nose flap 306 can be made out of polyethylene foam (e.g., about 2.0 mm thick) and a through air bonded carded web of polyethylene/polypropylene bicomponent fiber laminate and/or any of the materials described above for the layers of the mask body 102 and, in some implementations, has a low stiffness level (e.g., level 1) to allow it lay down over or on and conform to the shape of the nose of the wearer. The nose flap 306 can have a relief shaped portion 320 that is configured to accept the wearer's nose and not bunch the material of the nose flap 306. Further, in some implementations, the nose flap 306 may include a nose slit 308 configured to further allow the sides of the nose flap 306 to drop on either side of the wearer's nose without bunching or losing intimate contact with the wearer's skin.

Embodiments

Embodiment 1. An off-the-face mask comprising a mask body comprising one or more layers and having a surface area defined by a plurality of zones, wherein at least two of the plurality of zones have different stiffness levels; and one or more straps coupled to the mask body and configured to hold the mask on a wearer of the mask.

Embodiment 2. The mask of embodiment 1, wherein the different stiffness levels each correspond to a different thickness of the mask body.

Embodiment 3. The mask of any of the preceding embodiments, wherein the plurality of zones comprise a nose contacting portion proximate a nose of a wearer when the mask is worn; a chin contacting portion, opposite the nose contacting portion, proximate a chin of the wearer when the mask is worn; upper and lower left side portions collectively extending proximate a periphery of the mask body between the chin and nose contacting portions on one side of the mask body; upper and lower right side portions, opposite the left side portions, collectively extending proximate the periphery of the mask body between the chin and nose contacting portions on an other side of the mask body; and a first central portion surrounding an apex portion in a middle of the mask body; and a second central portion surrounding the first central portion and between the chin contacting, nose contacting, left side and right side portions; and at least two of the first central, second central, apex, chin contacting, nose contacting, upper and lower left side and right side portions have different stiffness levels.

Embodiment 4. The mask of embodiment 3, wherein the nose contacting portion has a lowest stiffness level.

Embodiment 5. The mask of any of embodiments 3-4, wherein at least one of the chin contacting portion and first central portion have a highest stiffness level.

Embodiment 6. The mask of any of embodiments 3-5, wherein the upper and lower left side and right side portions have stiffness levels greater than the nose contacting portion.

Embodiment 7. The mask of any of embodiments 3-6, wherein the first central portion has a stiffness level greater than the second central portion Embodiment 8. The mask of any of embodiments 3-7, wherein the first central and chin contacting portions have the same stiffness level.

Embodiment 9. The mask of any of the preceding embodiments, wherein one of the plurality of zones having the highest stiffness level has a thickness of between 0.3 to 2 mm.

Embodiment 10. The mask of any of the preceding embodiments, wherein the different stiffness levels have a lowest stiffness level and a highest stiffness level and the highest stiffness level is at least two times that of the lowest stiffness level.

Embodiment 11. The mask of any of the preceding embodiments, wherein one of the plurality of zones having the lowest stiffness level has a thickness of between 1.5 to 4 mm.

Embodiment 12. A method comprising forming a mask body comprising one or more layers, wherein the mask body has a surface area defined by a plurality of zones and at least two of the plurality of zones have different stiffness levels;

and attaching one or more straps to the mask body to hold the mask on a wearer of the mask.

Embodiment 13. The method of embodiment 12, wherein the different stiffness levels each correspond to a different thickness of the mask body.

Embodiment 14. The method of any of embodiments 12-13, wherein the plurality of zones comprise a nose contacting portion proximate a nose of the wearer when the mask is worn; a chin contacting portion, opposite the nose contacting portion, proximate a chin of the wearer when the mask is worn; upper and lower left side portions collectively extending proximate a periphery of the mask body between the chin and nose contacting portions on one side of the mask body; upper and lower right side portions, opposite the left side portion, collectively extending proximate the periphery of the mask body between the chin and nose contacting portions on an other side of the mask body; and a first central portion surrounding an apex portion in a middle of the mask body; and a second central portion surrounding the first central portion and between the chin contacting, nose contacting, upper and lower left side and right side portions; and at least two of the first central, second central, apex, chin contacting, nose contacting, upper and lower left side and right side portions have different stiffness levels.

Embodiment 15. The method of any of embodiments 12-14, wherein the nose contacting portion has a lowest stiffness level.

Embodiment 16. The method of any of embodiments 12-15, wherein at least one of the chin contacting portion and first central portion have a highest stiffness level.

Embodiment 17. The method of any of embodiments 12-16, wherein the upper and lower left side and right side portions have stiffness levels greater than the nose contacting portion.

Embodiment 18. The method of any of embodiments 12-17, wherein the first central portion has a stiffness level greater than the second central portion.

Embodiment 19. The method of any of embodiments 12-18, wherein the first central and chin contacting portions have the same stiffness level.

Embodiment 20. The method of any of embodiments 12-19, wherein the different stiffness levels have a lowest stiffness level and a highest stiffness level and the highest stiffness level is at least two or more preferably three or even more preferably four times that of the lowest stiffness level.

Embodiment 21. The method of any of embodiments 12-20, wherein one of the plurality of zones having the highest stiffness level has a thickness of between 0.3 to 2 mm.

Embodiment 22. The method of embodiment 21, wherein one of the plurality of zones having the lowest stiffness level has a thickness of between 1.5 to 4 mm.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. While this specification contains many specific implementation details, these should not be construed as limitations on the scope of any invention or of what may be claimed, but rather as descriptions of features that may be specific to particular embodiments of particular inventions, Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. An off-the-face mask comprising:

a mask body comprising one or more layers and having a surface area defined by a plurality of zones, wherein at least two of the plurality of zones have different stiffness levels; and one or more straps coupled to the mask body and configured to hold the mask on a wearer of the mask;

wherein:

the different stiffness levels each correspond to a different thickness of the mask body, the plurality of zones comprise a nose contacting portion proximate a nose of a wearer when the mask is worn; a chin contacting portion, opposite the nose contacting portion, proximate a chin of the wearer when the mask is worn; upper and lower left side portions collectively extending proximate a periphery of the mask body between the chin and nose contacting portions on one side of the mask body; upper and lower right side portions, opposite the left side portions, collectively extending proximate the periphery of the mask body between the chin and nose contacting portions on an other side of the mask body; and a first central portion surrounding an apex portion in a middle of the mask body; and a second central portion surrounding the first central portion and between the chin contacting, nose contacting, left side and right side portions; and at least two of the first central, second central, apex, chin contacting, nose contacting, upper and lower left side and right side portions have different stiffness levels, the nose contacting portion has a lowest stiffness level and at least one of the chin contacting portion and first central portion have a highest stiffness level, and wherein the upper and lower left side and right side portions have stiffness levels greater than the nose contacting portion and the first central portion has a stiffness level greater than the second central portion.

2. The mask of claim 1, wherein the first central and chin contacting portions have the same stiffness level.

3. The mask of claim 1, wherein the different stiffness levels have a lowest stiffness level and a highest stiffness level and the highest stiffness level is at least two times that of the lowest stiffness level.

4. The mask of claim 1, wherein one of the plurality of zones having the highest stiffness level has a thickness of between 0.3 to 2 mm.

5. The mask of claim 4, wherein one of the plurality of zones having the lowest stiffness level has a thickness of between 1.5 to 4 mm.

* * * * *